US010647566B2

(12) United States Patent
Kahler et al.

(10) Patent No.: US 10,647,566 B2
(45) Date of Patent: May 12, 2020

(54) DISPENSING METER AUTHORIZATION

(71) Applicant: Graco Minnesota Inc., Minneapolis, MN (US)

(72) Inventors: Bradley G. Kahler, Otsego, MN (US); Benjamin J. Paar, Minneapolis, MN (US); Glenn E. Highland, East Bethel, MN (US); Chad G. Igo, Coon Rapids, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 163 days.

(21) Appl. No.: 15/928,767

(22) Filed: Mar. 22, 2018

(65) Prior Publication Data

US 2019/0106319 A1 Apr. 11, 2019

Related U.S. Application Data

(60) Provisional application No. 62/570,141, filed on Oct. 10, 2017.

(51) Int. Cl.

*B67D 7/34* (2010.01)
*B67D 7/42* (2010.01)
*B67D 7/44* (2010.01)

(52) U.S. Cl.

CPC ..... *B67D 7/34* (2013.01); *B67D 7/346* (2013.01); *B67D 7/425* (2013.01); *B67D 7/426* (2013.01); *B67D 7/348* (2013.01); *B67D 7/44* (2013.01)

(58) Field of Classification Search

CPC ..... B67D 7/34; B67D 7/346; B67D 7/348; B67D 7/425; B67D 7/426; B67D 7/44

See application file for complete search history.

(56) References Cited

U.S. PATENT DOCUMENTS

| | | | |
|---|---|---|---|
| 4,469,149 | A | 9/1984 | Walkey et al. |
| 5,923,572 | A | 7/1999 | Pollock |
| 6,571,151 | B1 | 5/2003 | Leatherman |
| 6,585,009 | B2 | 7/2003 | Matthews et al. |
| 6,659,306 | B2 | 12/2003 | Boyle et al. |

(Continued)

FOREIGN PATENT DOCUMENTS

| | | | |
|---|---|---|---|
| JP | H08301396 | A | 11/1996 |
| KR | 20100068137 | A | 6/2010 |

(Continued)

OTHER PUBLICATIONS

International Search Report and Written Opinion of PCT International Application No. PCT/US2018/023858, dated Jul. 9, 2018, 16 pages.

(Continued)

*Primary Examiner* — Nirav G Patel
(74) *Attorney, Agent, or Firm* — Kinney & Lange, P.A.

(57) ABSTRACT

A fluid management system includes an authentication device and a fluid dispensing meter, and the fluid dispensing meter includes a processor and a memory. The authentication device is configured to provide user-identification data to the processor. The processor is configured to recall approved user identities from the memory, to compare the approved user identities to the user-identification data received from the authenticator, and to control a trigger control mechanism between the activated state and the deactivated state based on the comparison of the user-identification data and the approved user identities.

22 Claims, 10 Drawing Sheets

(56) References Cited

U.S. PATENT DOCUMENTS

| | | | |
|---|---|---|---|
| 7,082,969 | B1 | 8/2006 | Hollerback |
| 7,096,894 | B1 | 8/2006 | Hollub et al. |
| 7,551,087 | B2 | 6/2009 | McAllister |
| 7,647,954 | B2 | 1/2010 | Garber et al. |
| 7,778,600 | B2 | 8/2010 | Godwin et al. |
| 8,037,844 | B2 | 10/2011 | Mather et al. |
| 8,429,095 | B1 | 4/2013 | Ryan |
| 8,816,860 | B2 | 8/2014 | Ophardt et al. |
| 8,833,607 | B2 | 9/2014 | Wegelin et al. |
| 8,994,529 | B2 | 3/2015 | White |
| 9,053,503 | B2 | 6/2015 | Carapelli |
| 9,227,209 | B2 | 1/2016 | Mather et al. |
| 9,516,141 | B2 | 12/2016 | Dubois et al. |
| 9,558,486 | B2 | 1/2017 | Betancourt |
| 9,649,651 | B2 | 5/2017 | Mather et al. |
| 9,715,682 | B2 | 7/2017 | Webb et al. |
| 2002/0188382 | A1 | 12/2002 | Sherwood |
| 2006/0121844 | A1 | 6/2006 | Sparks, II |
| 2006/0139169 | A1 | 6/2006 | Reid et al. |
| 2006/0157149 | A1 | 7/2006 | Hillam et al. |
| 2007/0056983 | A1 | 3/2007 | Wells |
| 2009/0314797 | A1 | 12/2009 | Breeser |
| 2010/0200609 | A1 | 8/2010 | Cadigan |
| 2011/0166689 | A1 | 7/2011 | Alden et al. |
| 2011/0172816 | A1 | 7/2011 | Ezra |
| 2011/0245983 | A1 | 10/2011 | Beebe |
| 2013/0103585 | A1 | 4/2013 | Carapelli |
| 2013/0206279 | A1 | 8/2013 | Ryan |
| 2015/0025498 | A1 | 1/2015 | Estes |
| 2015/0120476 | A1 | 4/2015 | Harrell |
| 2015/0161590 | A1 | 6/2015 | Genovez |
| 2015/0375984 | A1 | 12/2015 | Arcand |
| 2016/0121352 | A1 | 5/2016 | Mather et al. |
| 2017/0073211 | A1 | 3/2017 | Wilson et al. |
| 2017/0109722 | A1 | 4/2017 | Morris et al. |
| 2017/0178257 | A1 | 6/2017 | Tingler et al. |
| 2017/0221116 | A1 | 8/2017 | Makke et al. |
| 2017/0247241 | A1 | 8/2017 | Blyth |
| 2017/0335988 | A1 | 11/2017 | Peret et al. |
| 2019/0274598 | A1 | 9/2019 | Scott et al. |

FOREIGN PATENT DOCUMENTS

| | | | |
|---|---|---|---|
| WO | WO2005045536 | A2 | 5/2005 |
| WO | WO2015066193 | A1 | 5/2015 |

OTHER PUBLICATIONS

Third Party Observation for PCT Application No. PCT/US2018/023861, dated Feb. 4, 2019, pp. 2.

International Search Report and Written Opinion for PCT Application No. PCT/US2018/023861, dated Jul. 10, 2018, pp. 13.

International Search Report and Written Opinion for PCT Application No. PCT/US2018/055237, dated Jan. 28, 2019, pp. 12.

International Report on Patentiblity for PCT Application No. PCT/US2018/023858, dated Sep. 24, 2019, pp. 15.

International Report on Patentiblity for PCT Application No. PCT/US2018/023861, dated Sep. 24, 2019, pp. 10.

DISPENSING METER AUTHORIZATION

CROSS-REFERENCE TO RELATED APPLICATION(S)

This application claims the benefit of U.S. Provisional Application No. 62/570,141, filed Oct. 10, 2017, and entitled "DISPENSING METER AUTHORIZATION," the disclosure of which is hereby incorporated by reference in its entirety.

BACKGROUND

The present disclosure relates to fluid dispensing. More particularly, this disclosure relates to fluid dispensing meters.

Fluid management has become increasingly important to control the costs of fluid overhead. For example, many vehicle fleet managers and auto dealerships have installed fluid management systems to efficiently dispense fluids, such as motor oil or transmission fluid. Such fluid management systems frequently include a fluid tank and pump located away from the dispensing point. Fluid management systems can include wireless transmission and reception of meter and tank level information to simplify tracking of fluid dispenses throughout an entire facility.

A fluid dispensing meter, also referred to as a metered valve or metering valve, can have different trigger designs. For example, a fluid dispensing meter can have a manual trigger or a pre-set fluid dispensing meter, which has a manual trigger but has the added functionality of automatically stopping a fluid dispense when a pre-set fluid dispense volume has been reached. Fluid dispensing meters can have the additional ability of preventing fluid dispenses until the meter has received dispense authorization via an RF signal that activates the trigger mechanism. The fluid dispensing meter can include a trigger actuation solenoid that controls activation of the trigger mechanism.

The fluid dispensing meter can require a user to enter a PIN code to authorize activation of the trigger mechanism by the solenoid. Current fluid management systems require the user to enter a PIN code on the meter interface to activate the meter and perform a fluid dispense. Similarly, the user is required to enter a work order number or scroll through a list of work orders on the meter interface screen to select the work order that the dispense is associated with. Both entering a PIN to activate the trigger mechanism and associating a work order with the dispense event are cumbersome and time consuming.

SUMMARY

According to one aspect of the disclosure, a fluid dispensing meter includes a trigger control mechanism, a data receiver, and a control board. The trigger control mechanism is mounted in a body of the fluid dispensing meter and is controllable between an activated state, where the fluid dispensing meter can dispense fluid, and a deactivated state, where the fluid dispensing meter is prevented from dispensing fluid. The data receiver is mounted on the fluid dispensing meter and is configured to receive data from an external data source. The control board includes a processor, and a memory encoded with instructions that, when executed by the processor, cause the processor to recall approved user identities from the memory, to compare the approved user identities to user-identification data received from an external data source, and to control the trigger control mechanism between the activated state and the deactivated state based on the comparison of the user-identification data and the approved user identities.

According to another aspect of the disclosure, a fluid management system includes an external data source configured to generate a user-identification signal that includes user-identification data, and a fluid dispensing meter. The fluid dispensing meter includes a trigger control mechanism, a data receiver, and a control board. The trigger control mechanism is mounted in a body of the fluid dispensing meter and is controllable between an activated state, where the fluid dispensing meter can dispense fluid, and a deactivated state, where the fluid dispensing meter is prevented from dispensing fluid. The data receiver is mounted on the fluid dispensing meter and is configured to receive data from the external data source. The control board includes a processor, and a memory encoded with instructions that, when executed by the processor, cause the processor to recall approved user identities from the memory, to compare the approved user identities to user-identification data received from an external data source, and to control the trigger control mechanism between the activated state and the deactivated state based on the comparison of the user-identification data and the approved user identities.

According to yet another aspect of the disclosure, a method of authorizing a fluid dispense includes receiving user-identification data at a processor of a fluid dispensing meter, the user-identification data configured to identify a user; recalling, from a memory of the fluid dispensing meter, a list of authorized users and comparing, with the processor, the user-identification data and the list of authorized users; determining, with the processor, an authorization status of the user based on the comparison of the user-identification data and the list of authorized users; and controlling, with the processor, a trigger control mechanism of the fluid dispensing meter between an activated state and a deactivated state based on the authorization status of the user.

DETAILED DESCRIPTION

Figure 1A:
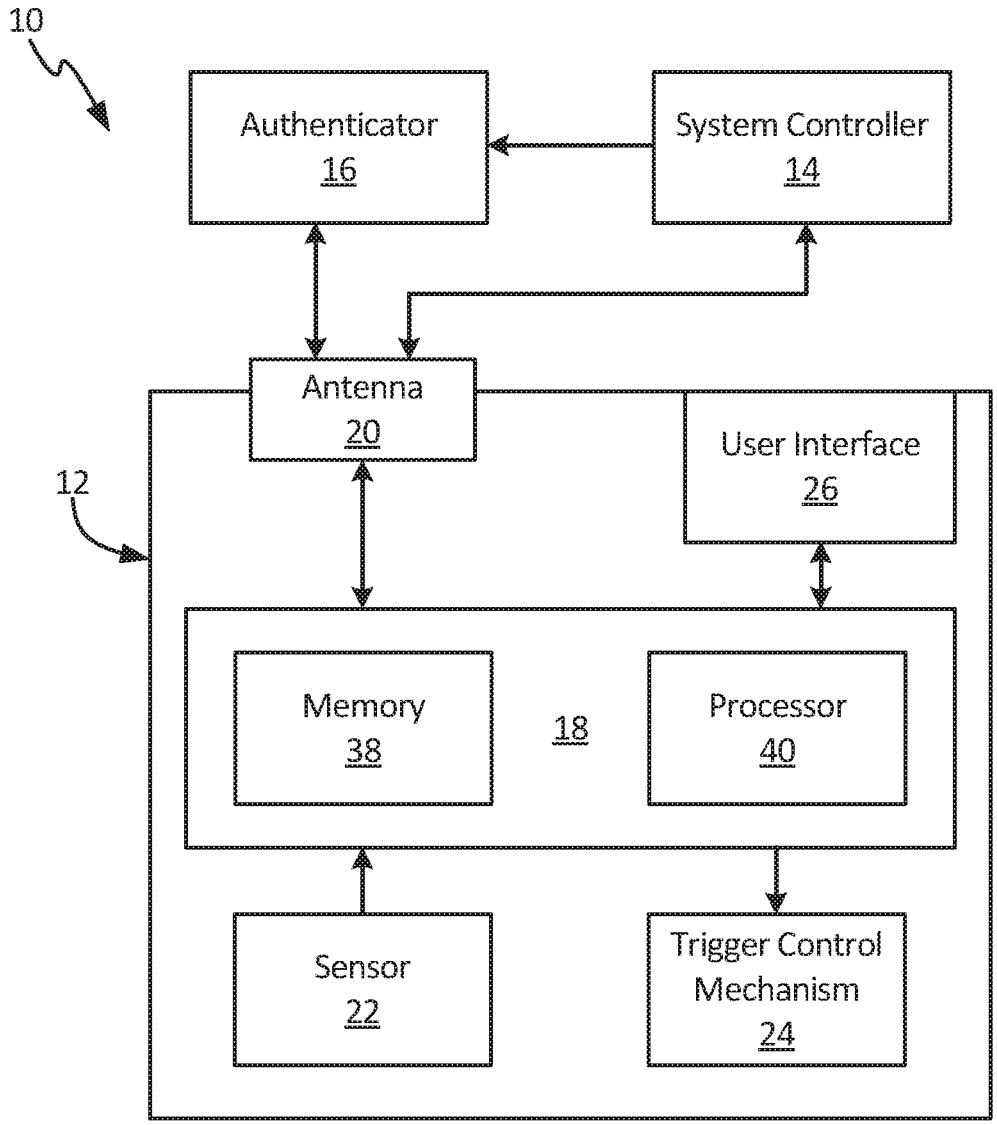
FIG. 1A is a schematic block diagram of a fluid management system.
Figure 1B:
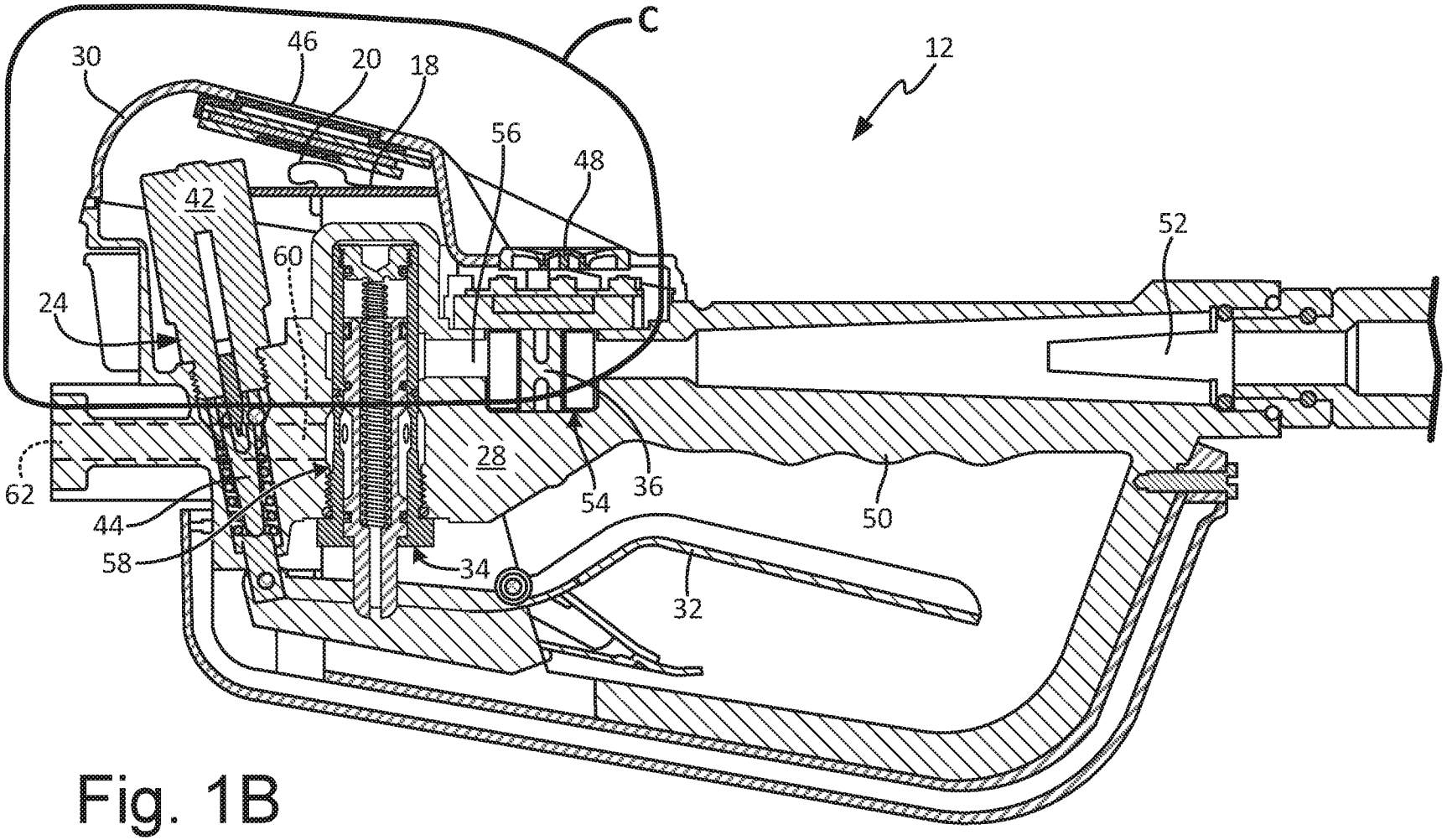
FIG. 1B is a cross-sectional view of a fluid dispensing meter.
Figure 1C:
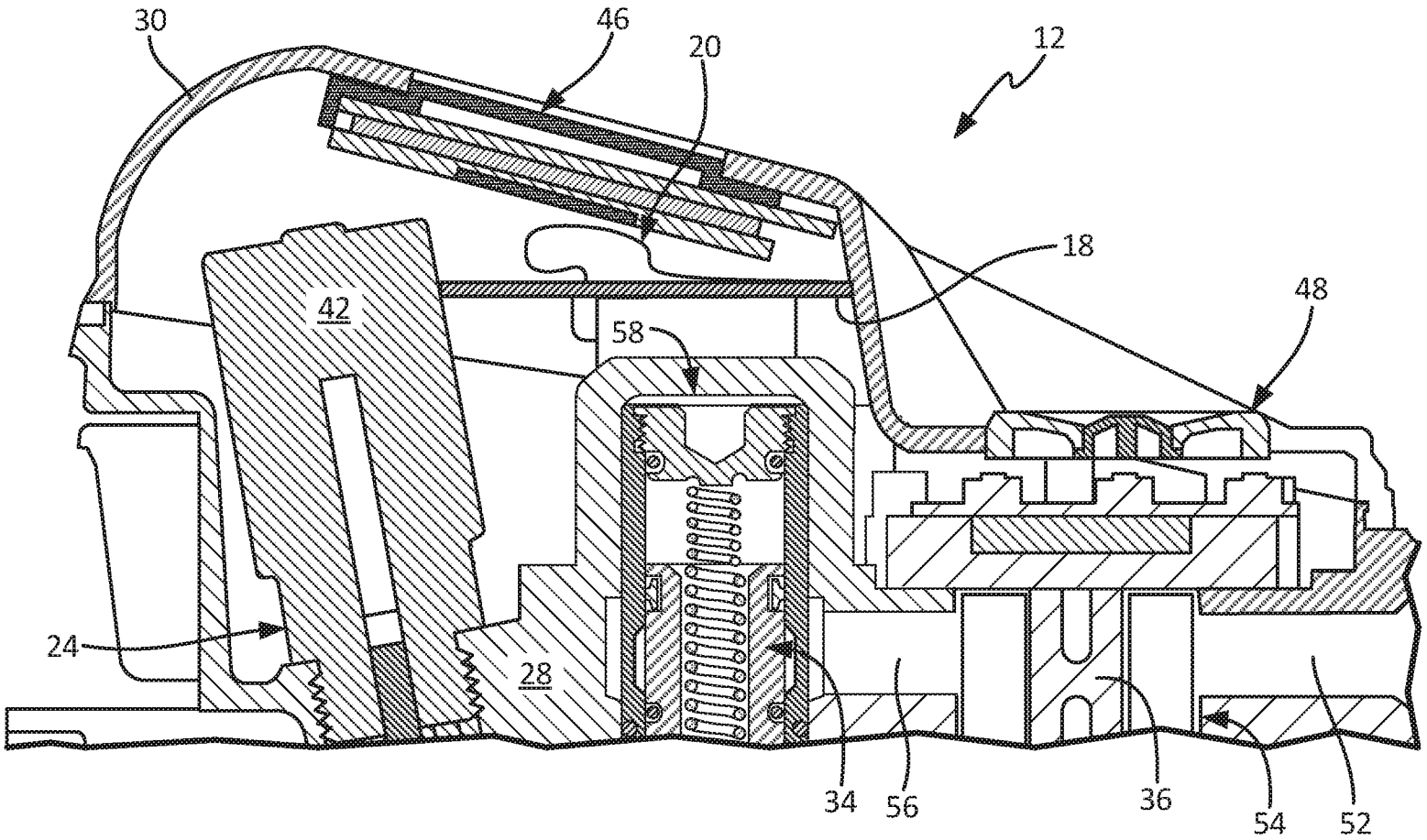
FIG. 1C is an enlarged view of detail Z in FIG. 1B.

FIG. 1A is a schematic block diagram of fluid management system 10. FIG. 1B is a cross-sectional view of fluid dispensing meter 12. FIG. 1C is an enlarged view of detail C in FIG. 1B. FIGS. 1A-1C will be discussed together. Fluid management system 10 includes fluid dispensing meter 12, system controller 14, and authenticator 16. Fluid dispensing meter 12 includes control board 18, antenna 20, sensor 22, trigger control mechanism 24, user interface 26, meter body 28, bezel housing 30, trigger 32, valve 34, and meter 36. Control board 18 includes memory 38 and processor 40. Trigger control mechanism 24 includes solenoid 42 and trip rod 44. User interface 26 includes display screen 46 and user input 48. Meter body 28 includes handle 50, fluid inlet 52, metering chamber 54, valve inlet port 56, valve cavity 58, valve outlet port 60, and fluid outlet 62.

Fluid management system 10 is a system for dispensing fluid and tracking fluid dispenses. For example, fluid management system 10 can be implemented in an automotive shop to track dispenses of oil, coolant, and other automotive fluids. Fluid dispensing meter 12 is configured to dispense and meter fluid at various locations within fluid management system 10. Fluid management software is implemented on system controller 14, and system controller 14 is configured to generate work orders, track and record discrete fluid dispense events, and implement system-wide fluid tracking. It is understood that system controller 14 can be any suitable processor-based device for generating work orders and managing fluid data within fluid management system. For example, system controller 14 can be a PC or a mobile device, such as a smart phone, personal data assistant, handheld bill payment machine, and/or a mobile point of sale system.

Bezel housing 30 is mounted on meter body 28 and is configured to enclose the various electronics of fluid dispensing meter 12. Control board 18 is disposed in bezel housing 30 and is in communication with antenna 20, user interface 26, sensor 22, and trigger control mechanism 24. Control board 18 is mounted in bezel housing 30 below antenna 20. Antenna 20 is mounted in bezel housing 30 between control board 18 and display screen 46, and antenna 20 communicates with processor 40. While antenna 20 is described as disposed within bezel housing 30, it is understood that antenna 20 can be mounted at any desired location where antenna 20 can communicate with authenticator 16 and processor 40. For example, antenna 20 can extend through handle 50 or project out of bezel housing 30. Antenna 20 can also be referred to as a data receiver.

Memory 38 and processor 40 are mounted on control board 18. While memory 38 and processor 40 are shown on a common control board 18, it is understood that memory 38 and processor 40 can be mounted on separate circuit boards and electrically connected, such as by wiring. Memory 38 stores software that, when executed by processor 40, authorizes fluid dispenses, tracks and records the volume of each fluid dispense, and communicates fluid dispense information to and from the user. User interface 26 is disposed on and in bezel housing 30 and is configured to receive inputs from and provide outputs to the user.

Processor 40, in one example, is configured to implement functionality and/or process instructions. For instance, processor 40 can be capable of processing instructions stored in memory 38. Examples of processor 40 can include any one or more of a microprocessor, a controller, a digital signal processor (DSP), an application specific integrated circuit (ASIC), a field-programmable gate array (FPGA), or other equivalent discrete or integrated logic circuitry.

Memory 38, in some examples, can be configured to store information during operation. Memory 38, in some examples, is described as computer-readable storage media. In some examples, a computer-readable storage medium can include a non-transitory medium. The term "non-transitory" can indicate that the storage medium is not embodied in a carrier wave or a propagated signal. In some examples, memory 38 is a temporary memory, meaning that a primary purpose of memory 38 is not long-term storage. Memory 38, in some examples, is described as volatile memory, meaning that memory 38 does not maintain stored contents when power to fluid dispensing meter 12 is turned off. Memory 38, in some examples, also includes one or more computer-readable storage media. Memory 38 can be configured to store larger amounts of information than volatile memory. Memory 38 can further be configured for long-term storage of information. In some examples, memory 38 includes non-volatile storage elements.

Handle 50 is configured to be grasped by a single hand of a user, such that the user can manipulate fluid dispensing meter 12 and dispense fluid at a desired location with one hand. Fluid inlet 52 extends into handle 50 and is configured to receive a supply hose extending from a fluid storage tank. Metering chamber 54 is disposed in meter body 28, and meter 36 is disposed in metering chamber 54. Meter 36, in some examples, can be a positive displacement meter configured to generate a volumetric measurement of the fluid flowing through fluid dispensing meter 12. Sensor 22 interfaces with meter 36 and is configured to generate a volumetric flow count based on the volumetric measurement generated by meter 36. Valve inlet port 56 extends between metering chamber 54 and valve cavity 58. Valve 34 is disposed in valve cavity 58 and is configured to control fluid flow through fluid dispensing meter 12. Valve outlet port 60 extends downstream from valve cavity 58. Fluid outlet 62 is configured to receive the fluid flow from valve outlet port 60 and extends out of meter body 28.

Trigger 32 extends from meter body 28 and interfaces with valve 34. Trigger control mechanism 24 is mounted on meter body 28 and is configured to control trigger 32 between an activated state, where trigger 32 can displace valve 34 between a closed position and an open position, and a deactivated state, where trigger 32 is prevented from displacing valve 34 between the closed position and the open position. Solenoid 42 is mounted on meter body 28 and extends into bezel housing 30. Trip rod 44 extends from solenoid 42 and is connected to trigger 32. When trigger control mechanism 24 is activated, solenoid 42 locks trip rod 44 in position. With trip rod 44 locked in position, trigger 32 pivots on trip rod 44 such that trigger 32 can displace valve 34 to the open position. When trigger control mechanism 24 is deactivated, solenoid 42 unlocks trip rod 44 such that trip rod 44 is capable of sliding within meter body 28. With trip rod 44 unlocked, trigger 32 cannot pivot on trip rod 44 and instead pivots on valve 34, pulling trip rod 44 downward within meter body 28. As such, trigger 32 is prevented from shifting valve 34 to the open position with trigger control mechanism 24 deactivated. Trigger control mechanism 24 operates substantially similar to the trigger release mechanism disclosed in U.S. Pat. No. 8,215,522, to Graco Minn., Inc., the disclosure of which is hereby incorporated by reference in its entirety.

Authenticator 16, which can also be referred to as an external data source, passively provides dispense-identification data, such as user-identification data that identifies a particular user and/or a group of users, to fluid dispensing meter 12. The dispense-identification data can include the user identity and work orders associated with the user, among other data. The user-identification data is provided to fluid dispensing meter 12 via the communication link between authenticator 16 and antenna 20. As such, authenticator 16 authorizes dispenses and can set fluid limits on dispenses without requiring direct communication between system controller 14 and fluid dispensing meter 12. In some examples, authenticator 16 is a Near Field Communication ("NFC") device configured to provide the user-identification data to fluid dispensing meter 12. Examples of authenticator 16 can include an NFC-configured wrist band, an NFC-configured ring, an NFC-configured access card, or any other suitable NFC-configured device. Where authenticator 16 is an NFC-enabled device, an NFC chip can be embedded on control board 18. While authenticator 16 is described as utilizing NFC to communicate with fluid dispensing meter 12, it is understood that authenticator 16 can additionally or alternatively utilize any desired communication standard to communicate with fluid dispensing meter 12. For example, authenticator 16 can utilize Bluetooth SIG (e.g., Bluetooth 5, Bluetooth low energy protocol stack, Bluetooth Ultra Low Power, etc.), Wibree, BlueZ, Affix, ISO 13157, IEEE 802/Wi Fi, ISO/IEC 15693, ISO/IEC 14443, ISM band, WLAN, active RFID (e.g., Active Reader Active Tag), passive RFID (e.g., Active Reader Passive Tag), NFCIP-1, ISO/IEC 18092, among other options.

During operation, a work order associated with a discrete fluid dispense event is entered at system controller 14. The work order contains relevant dispense information, such as the type of fluid to be dispensed, the volume of fluid to be dispensed, the customer associated with the work order, the desired location of the dispense, and/or the identities of users authorized to make the dispense, among other desired information. In some examples, the work order includes a list of authorized users, which are the users authorized to complete the dispense event identified by the work order. The work order can be provided to fluid dispensing meter 12 via the communication link between system controller 14 and fluid dispensing meter 12. The work order information can be stored in memory 38.

The user, such as an automotive technician, proceeds to fluid dispensing meter 12 with authenticator 16, which includes the dispense-identification data. When the user grasps fluid dispensing meter 12, authenticator 16 provides the user-identification data to processor 40 via the communication link between authenticator 16 and antenna 20. In some examples, authenticator 16 is required to be within a short distance of antenna 20 to transmit the user-identification data, such as about 2.54-5.08 cm (about 1.00-2.00 in.). Processor 40 recalls the work order information from memory 38 and compares the work order information to the user-identification data to determine if the dispense event is authorized and if the user is authorized to complete a dispense event. For example, memory 38 can contain a list of authorized users that processor 40 compares with the user-identification data. The list of authorized users can include all users authorized to make dispenses or can include particular users associated with particular work orders. In examples where the dispense-identification data includes work order-identification data, processor 40 also receives the work order-identification data from authenticator 16. Processor 40 can then automatically associate the user with the work order.

In some examples, multiple work orders are associated with one user. Processor 40 recalls the work order data from memory 38 and can display a list of work orders to the user via user interface 26. In examples where the work order data includes a list of authorized users, the list displayed to the user contains only those work orders for which the user is authorized to complete the dispense. The user can then select the work order associated with the current dispense event via user interface 26.

If processor 40 determines that the dispense event is authorized based on the comparison, then processor 40 enables fluid dispensing meter 12 to proceed with the dispense event. Processor 40 activates trigger control mechanism 24, such as by activating a power source for solenoid 42 to thereby power solenoid 42. With trigger control mechanism 24 activated, trigger 32 is able to shift valve 34 to the open position. The user is then able to dispense the fluid using fluid dispensing meter 12. If processor 40 determines that the dispense event is not authorized based on the comparison, such as where the user-identification data does not match any user on the list of authorized users, then trigger control mechanism 24 remains deactivated such that the user cannot dispense fluid with fluid dispensing meter 12. Fluid dispensing meter 12 can transmit information regarding the dispense event to system controller 14 for work order management and system-wide fluid tracking.

Fluid management system 10 provides significant advantages. Authenticator 16 uniquely identifies a user, and processor 40 is configured to authorize fluid dispenses only when authenticator 16 is within range of antenna 20 and when processor 40 determines that the user-identification data matches the list of authorized users. As such, processor 40 and authenticator 16 prevent unauthorized fluid dispenses, as fluid dispensing meter 12 remains deactivated until processor 40 activates trigger control mechanism 24. Unlocking fluid dispensing meter 12 with authenticator 16 also eliminates the need for the user to remember and enter a PIN code to unlock fluid dispensing meter 12. Instead, the user can simply pick up fluid dispensing meter 12 and processor 40 unlocks fluid dispensing meter 12 based on the proximity of authenticator 16.

Figure 2A:
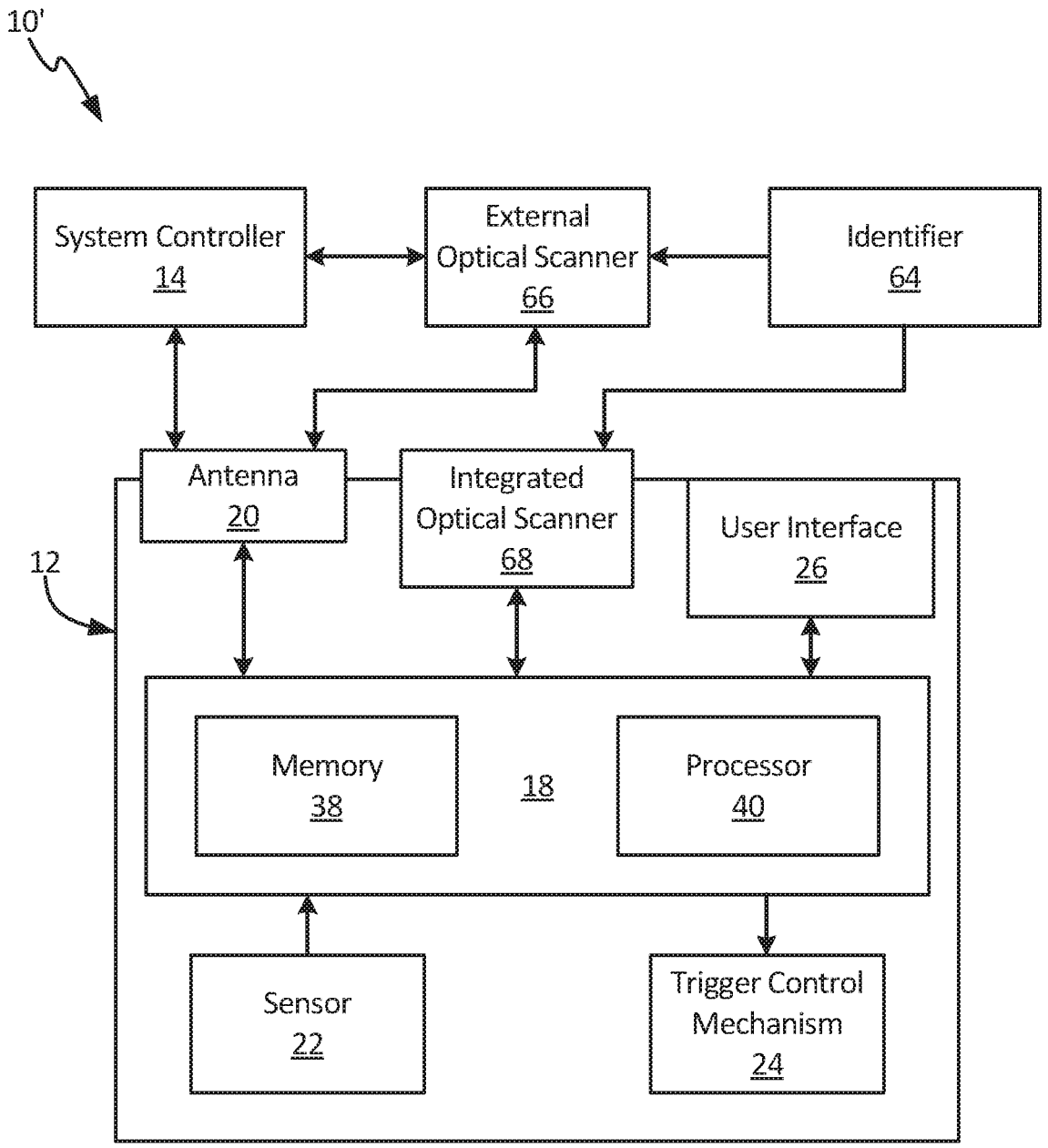
FIG. 2A is a schematic block diagram of a fluid management system.
Figure 2B:
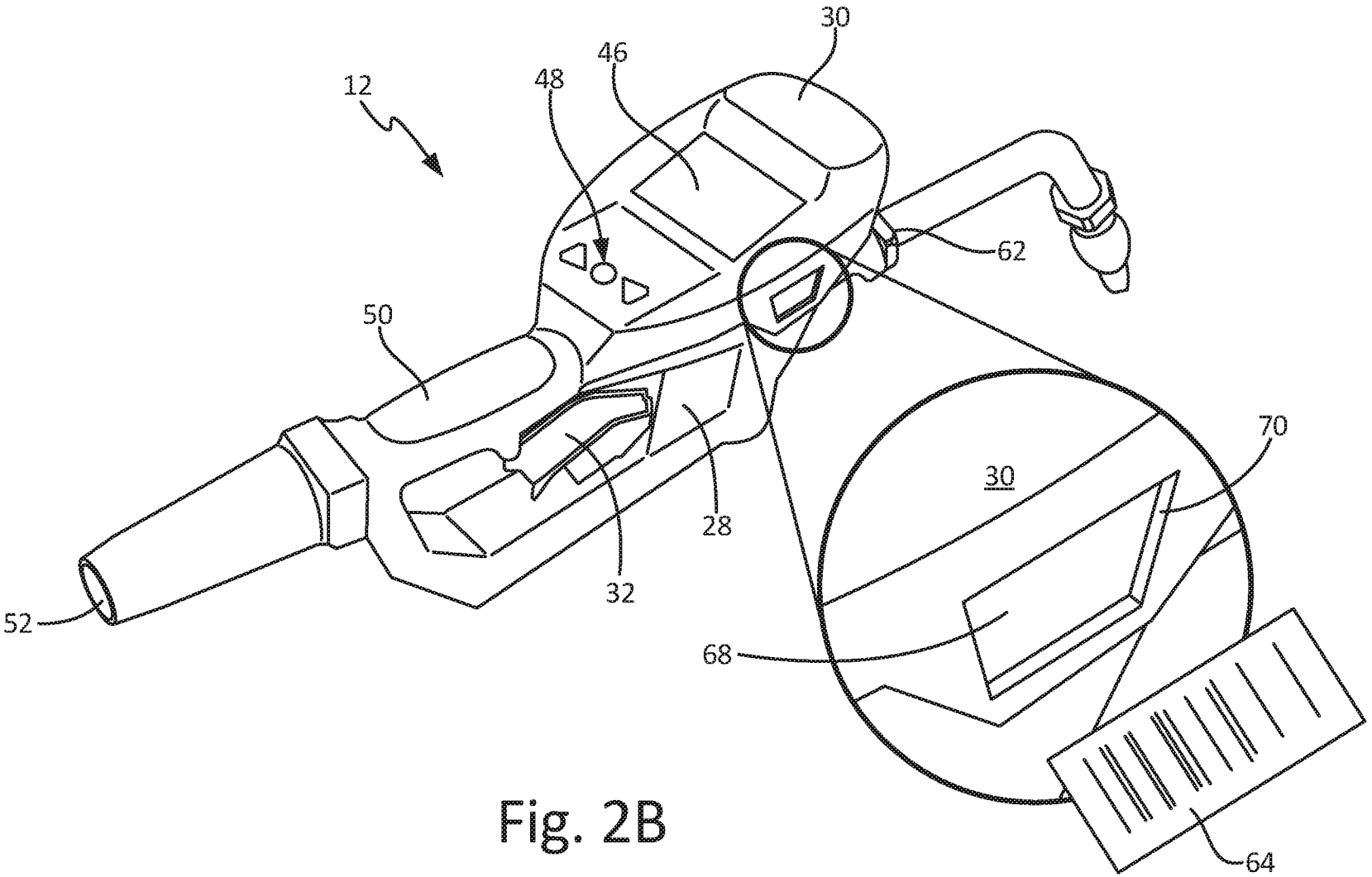
FIG. 2B is a perspective view of a fluid dispensing meter.
Figure 2C:
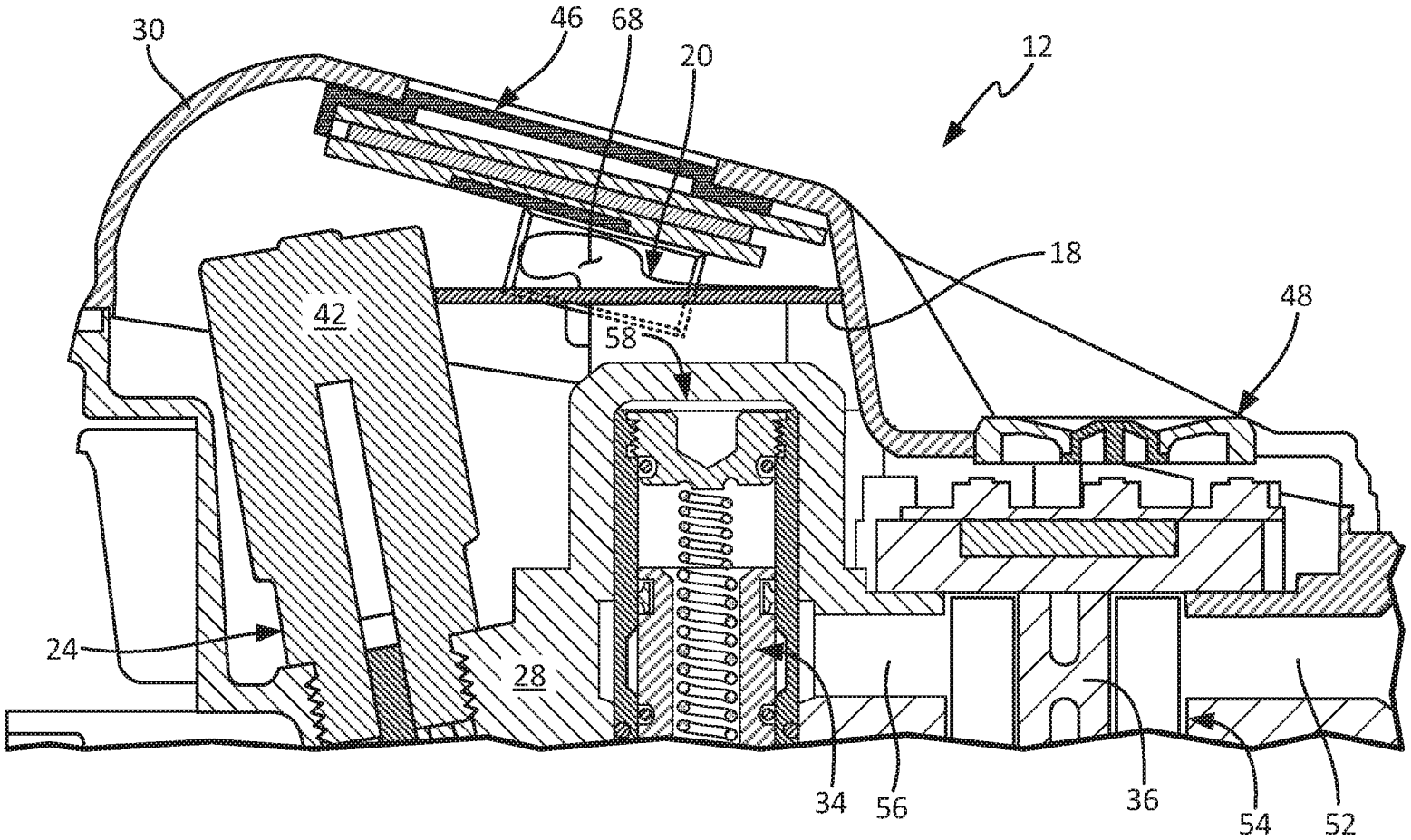
FIG. 2C is a cross-sectional view of a portion of a dispensing meter.

FIG. 2A is a schematic block diagram of fluid management system 10'. FIG. 2B is an isometric view of fluid dispensing meter 12 with an enlarged view of integrated optical scanner 68 and scanner opening 70. FIG. 2C is a cross-sectional view of a portion of fluid dispensing meter 12. FIGS. 2A-2C will be discussed together. Fluid management system 10' includes fluid dispensing meter 12, system controller 14, visual pattern 64, and external optical scanner 66. Fluid dispensing meter 12 includes control board 18, antenna 20, sensor 22, trigger control mechanism 24, user interface 26, meter body 28, bezel housing 30, trigger 32, valve 34, meter 36, and integrated optical scanner 68. Control board 18 includes memory 38 and processor 40. Solenoid 42 of trigger control mechanism 24 is shown. User interface 26 includes display screen 46 and user input 48. Handle 50, fluid inlet 52, metering chamber 54, valve inlet port 56, valve cavity 58, and fluid outlet 62 of meter body 28 are shown. Bezel housing 30 includes scanner opening 70.

Fluid dispensing meter 12 is configured to meter and dispense fluid at various locations within fluid management system 10'. Fluid management software is implemented on system controller 14, and system controller 14 is configured to generate work orders, track and record discrete fluid dispense events, and implement system-wide fluid tracking. It is understood that system controller 14 can be any suitable processor-based device for generating work orders and managing fluid data within fluid management system. For example, system controller 14 can be a PC or a mobile device, such as a smart phone, personal data assistant, handheld bill payment machine, and/or a mobile point of sale system.

Visual pattern 64, which can also be referred to as an external data source, includes a unique identifier that is associated with a work order and/or a user authorized to make a fluid dispense. As such, the unique identifier provides dispense-identification data. For example, the unique identifier data can include user-identification data where visual pattern 64 is associated with a unique user, work order-identification data where visual pattern 64 is associated with a work order, or both where visual pattern 64 is associated with both a user and a work order. Visual pattern 64 can be any visual pattern configured to uniquely identify the user, the work order, or both. For example, visual pattern 64 can be a bar code or a QR code. Each authorized user of fluid management system 10' can be issued a unique visual pattern 64 and/or a unique visual pattern 64 can be generated for each work order. Visual pattern 64 can be disposed on a paper print out and/or can be displayed on the screen of a device.

Figure 3:
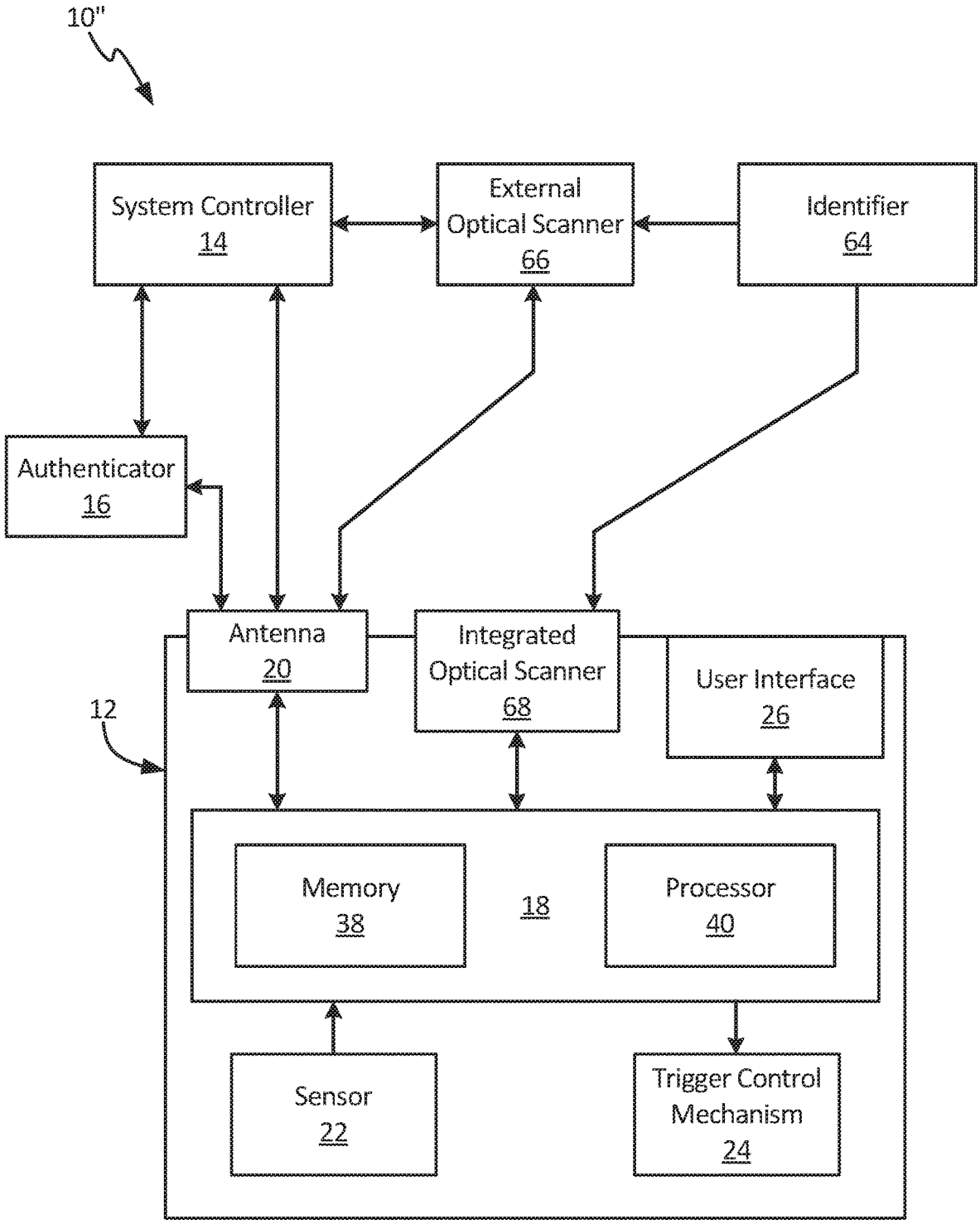
FIG. 3 is a schematic block diagram of a fluid management system.

External optical scanner 66 is configured to perform optical pattern recognition and produce coded signals corresponding to the patterns recognized. For example, external optical scanner 66 can be a bar code scanner. External optical scanner 66 is a separate component from fluid dispensing meter 12. While external optical scanner 66 is illustrated as separate from system controller 14, it is understood that external optical scanner 66 can be integrated into system controller 14, such as where system controller 14 is a smartphone or tablet device. External optical scanner 66 can also communicate visual pattern 64 to fluid dispensing meter 12, either directly or through by way of system controller 14. In some examples, external optical scanner 66 can be equipped with NFC card emulation, similar to authenticator 16 (FIGS. 1A and 3).

Similar to external optical scanner 66, integrated optical scanner 68 is configured to perform optical pattern recognition and produce coded signals corresponding to the patterns recognized. Integrated optical scanner 68 integrated into the electronics of fluid dispensing meter 12 and communicates with processor 40. Integrated optical scanner 68 is mounted in bezel housing 30 and receives visual pattern 64 through scanner opening 70 in bezel housing 30. While scanner opening 70 is illustrated on a side of bezel housing 30, it is understood that scanner opening 70, and integrated optical scanner 68, can be located at any desired location on fluid dispensing meter 12 where integrated optical scanner 68 maintains communications with control board 18. For example, scanner opening 70 can extend through a left-hand side of bezel housing 30, a right-hand side of bezel housing 30, a front of bezel housing 30, and through a hand guard extending around trigger 32. A user can activate integrated optical scanner 68 via user interface 26. Integrated optical scanner 68 can also be referred to as a data receiver.

During operation, fluid dispensing meter 12 utilizes the unique identifier from visual pattern 64 to authorize a fluid dispense event. The user can scan visual pattern 64 with either external optical scanner 66 or integrated optical scanner 68 and the dispense-identification data is transmitted to processor 40. Where the user utilizes external optical scanner 66, external optical scanner 66 transmits the dispense-identification data from visual pattern 64 to fluid dispensing meter 12 either directly via the communication link between external optical scanner 66 and fluid dispensing meter 12, or through system controller 14. Where the user utilizes integrated optical scanner 68, the dispense-identification data is provided directly to processor 40 by integrated optical scanner 68. Processor 40 recalls authorized-dispense data from memory 38 and compares the authorized-dispense data to the dispense-identification data to determine if the dispense event is authorized. The authorized-dispense data can include, among others, a list of authorized users and a list of work orders that fluid dispensing meter 12 is authorized to complete.

Processor 40 compares the dispense-identifier data from visual pattern 64 to the authorized-dispense data stored in memory 38. For example, where visual pattern 64 identifies a user, processor 40 compares the user-identification data from visual pattern 64 to a list of authorized users stored in memory 38. If processor 40 determines that the dispense event is authorized, then processor 40 activates trigger control mechanism 24 such that trigger 32 can shift valve 34 to the open position and the user can dispense fluid with fluid dispensing meter 12. With trigger control mechanism 24 activated, the user can dispense the fluid using fluid dispensing meter 12. Processor 40 can end the dispense event by deactivating trigger control mechanism 24, such as where sensor 22 indicates that the actual fluid volume dispensed has reached an authorized fluid volume. Fluid dispensing meter 12 can transmit information regarding the dispense event to system controller 14 for work order management and system-wide fluid tracking.

Fluid management system 10' provides significant advantages. Visual pattern 64 provides unique identification for both work orders and users authorized to make fluid dispenses. Processor 40 is configured to authorized fluid dispenses only when processor 40 determines that the dispense-identification data matches the authorized-dispense data stored in memory 38. Integrated optical scanner 68 allows the dispense-identification data contained in visual pattern 64 to be provided directly to fluid dispensing meter 12 at the dispense location. Providing the dispense-identification data from integrated optical scanner 68 or external optical scanner 66 eliminates the need for the user to remember a PIN code and does not require the user to interact with user interface 26 to unlock fluid dispensing meter 12.

FIG. 3 is a schematic block diagram of fluid management system 10". Fluid management system 10" includes fluid dispensing meter 12, system controller 14, authenticator 16, visual pattern 64, and external optical scanner 66. Fluid dispensing meter 12 includes control board 18, antenna 20, sensor 22, trigger control mechanism 24, user interface 26, and integrated optical scanner 68. Control board 18 includes memory 38 and processor 40.

Fluid dispensing meter 12 can be configured to authorize fluid dispenses based on two-part authentication from visual pattern 64 and authenticator 16. Visual pattern 64 and authenticator 16 are both external data sources. The user scans visual pattern 64 with one of external optical scanner 66 and integrated optical scanner 68. The dispense-identification data received from visual pattern 64 is transmitted to control board 18 and can be stored in memory 38 to be recalled at a later time. For example, multiple work orders can be scanned and the work order-identification data for each unique work order can be stored in memory 38. Each unique work order can be associated with one or more users authorized to complete the work order, such that only those users are authorized to complete fluid dispense for those work orders. To initiate the dispense event, the user grasps fluid dispending meter 36, bringing authenticator 16 within range of antenna 20. In some examples, the user scans visual pattern 64 with integrated optical scanner 68 at the beginning of the dispense event to activate a work order identified by work order-identification data contained in visual pattern 64.

With the work order activated, processor 40 compares the user-identification data received from authenticator 16 with the list of users authorized to complete that work order. If processor 40 determines that the dispense event is authorized, then processor 40 activates trigger control mechanism 24 such that the user can pull trigger 32 (best seen in FIG. 1B) and shift valve 34 (shown in FIG. 1B) to the open position. If processor 40 determines that the dispense event is unauthorized, then processor 40 does not activate trigger control mechanism 24, and fluid dispensing meter 12 is unable to dispense fluid.

Fluid management system 10" provides significant advantages. Authenticator 16 uniquely identifies a dispense event and/or a user, and processor 40 is configured to authorize fluid dispenses only when authenticator 16 is within range of antenna 20 and when processor 40 determines that the user-identification data matches a list of authorized users stored in memory 38. Visual pattern 64 provides unique dispense-identification data to fluid dispensing meter 12. Processor 40 can recall a list of work orders from memory 38 and identify if the user is authorized to make the fluid dispense based on the user-identification data provide by authenticator 16 and the list of work orders associated with that user-identification data. Passively identifying users with authenticator 16 and automatically activating fluid dispensing meter 12 based on user-identification data allows the user to more quickly and efficiently dispense fluid, as the user is not required to remember a PIN code or actively log into fluid dispensing meter 12.

Figure 4:
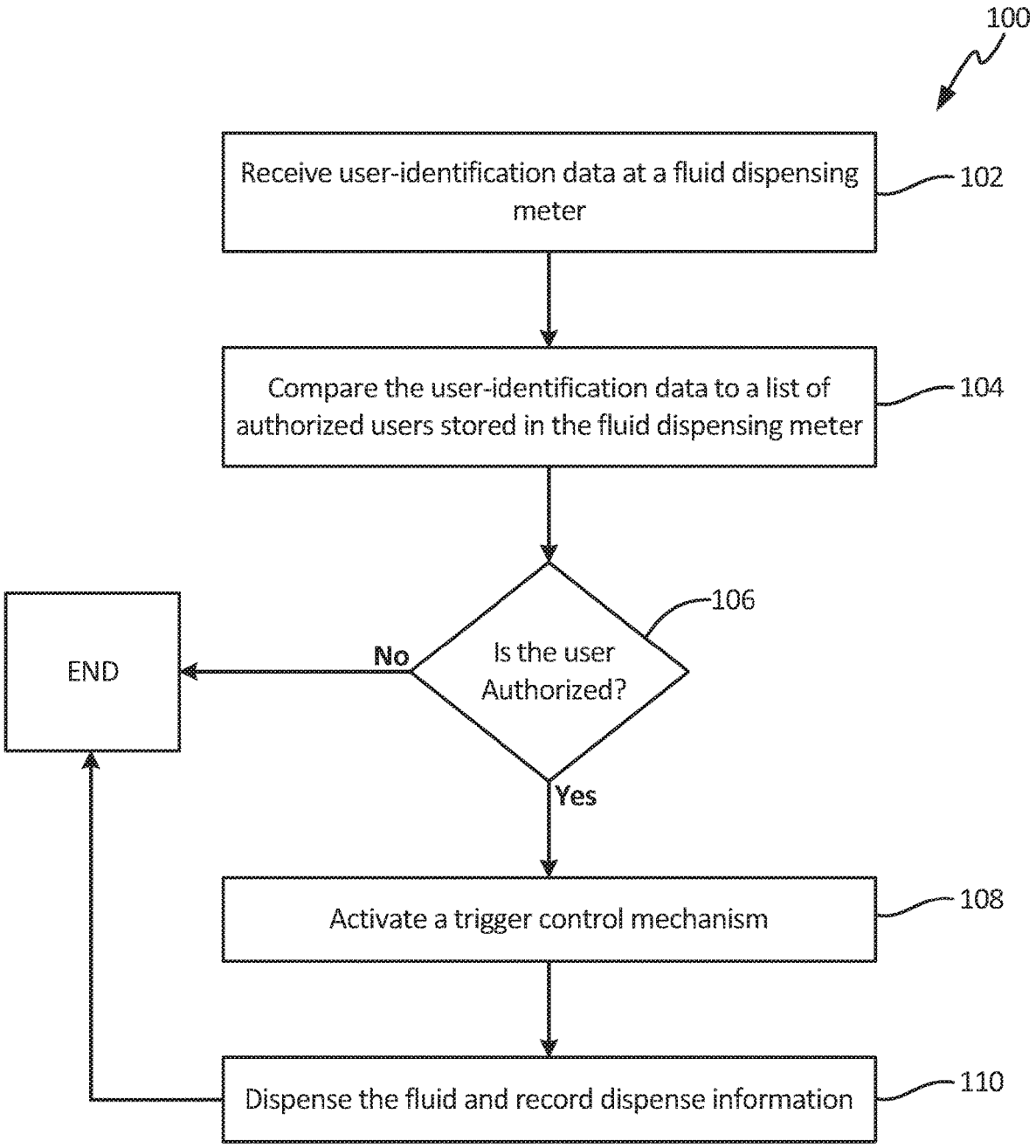
FIG. 4 is a flowchart illustrating a method of dispensing fluid.
Figure 5:
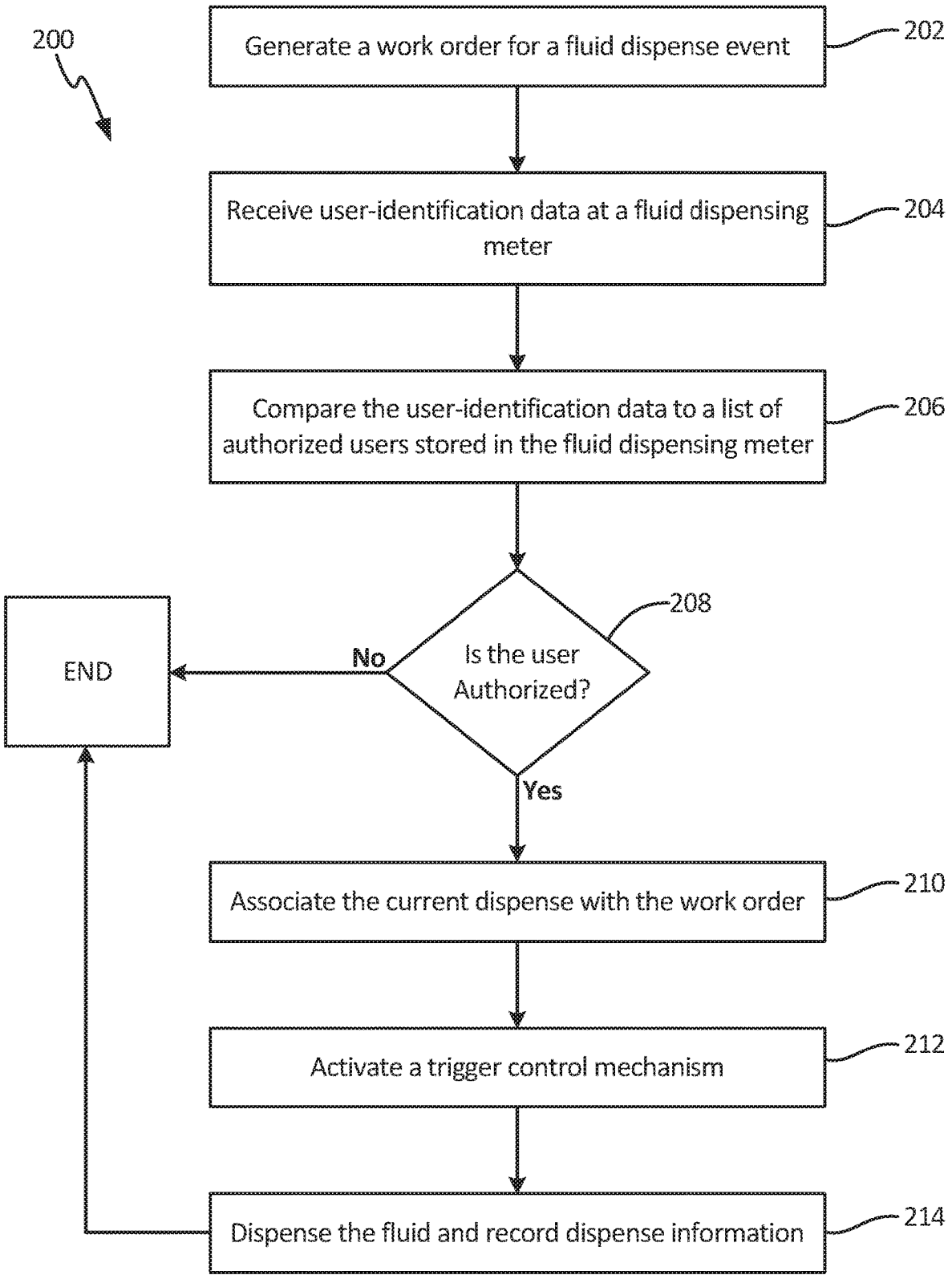
FIG. 5 is a flowchart illustrating a method of dispensing fluid.
Figure 6:
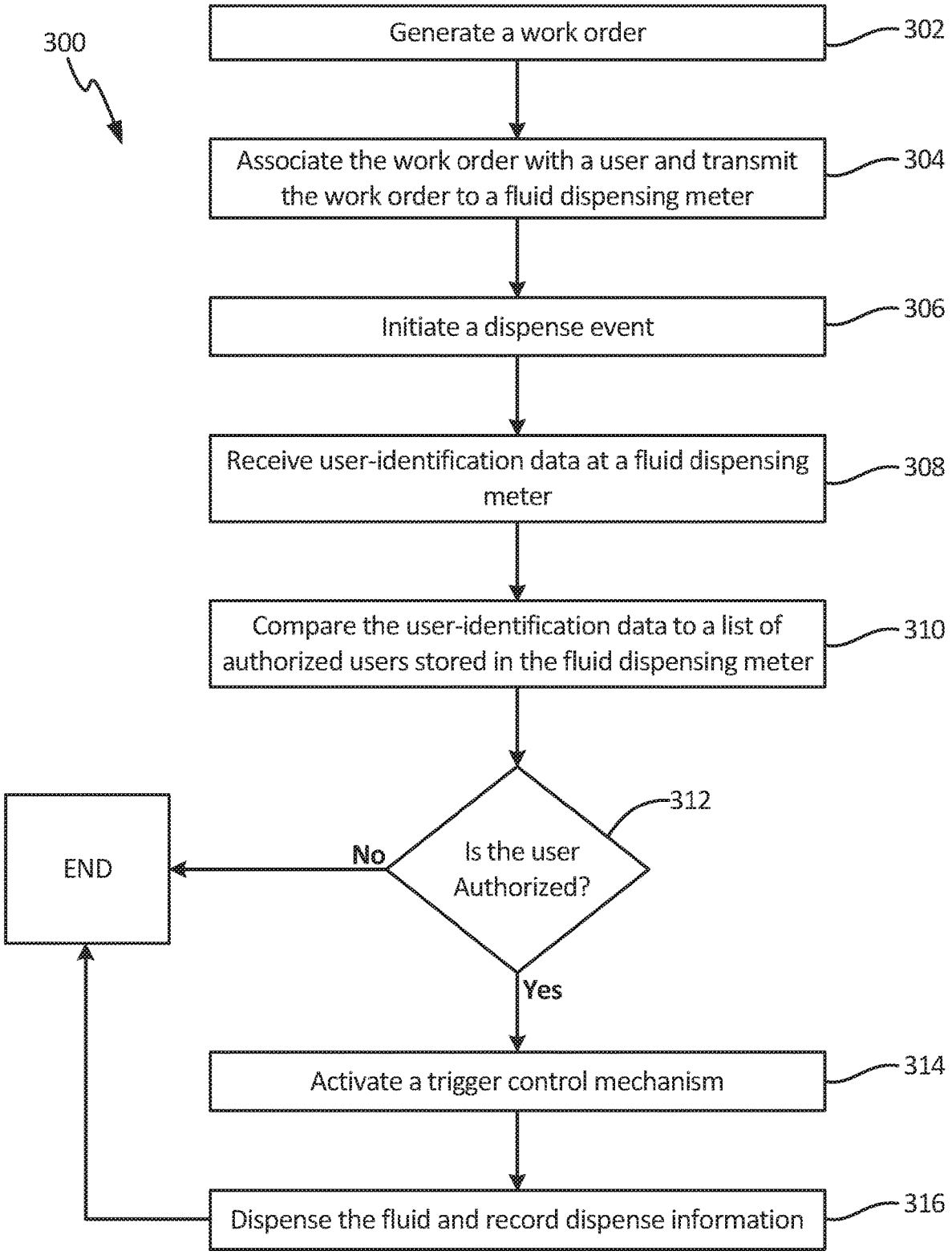
FIG. 6 is a flowchart illustrating a method of dispensing fluid.

FIG. 4, FIG. 5, and FIG. 6 are flowcharts illustrating methods of dispensing fluid. FIGS. 4-6 differ in the level of authorization required for the user. FIG. 4 illustrates method 100 of authorizing a fluid dispense that requires user authorization at fluid dispensing meter 12, such as by authenticator 16 (FIGS. 1 and 3). FIG. 5 illustrates method 200 of authorizing a fluid dispense that requires generation of a work order and user authorization at fluid dispensing meter 12. FIG. 6 illustrates method 300 of authorizing a fluid dispense that requires generation of a work order and association of specific users with that work order. User authorization is still required at fluid dispensing meter 12, but the user is required to be authorized to both dispense fluid using fluid dispensing meter 12 and dispense fluid for that work order.

FIG. 4 is a flowchart illustrating method 100 of authorizing a fluid dispense. In step 102, dispense-authorization data, such as user-identification data and/or work order-identification data, is received by a fluid dispensing meter, such as fluid dispensing meter 12 (FIGS. 1A-3). The user-identification data can be passively provided to the fluid dispensing meter by an authentication device utilizing near field communications, such as authenticator 16 (FIGS. 1A and 3). For example, the user can wear a bracelet, watch, ring, belt, or other authentication device that is NFC enabled, and the user-identification data can be transmitted to a processor of the fluid dispensing meter by the authenticator. In another example, the user-identification data is encoded in a visual identifier, such as visual pattern 64 (FIGS. 2A-2B and 3). The user can scan the visual identifier using an optical scanner, such as external optical scanner 66 (FIGS. 2A and 3) or integrated optical scanner 68 (FIGS. 2A-3).

In step 104, the user-identification data provided to the fluid dispensing meter in step 102 is compared to a list of authorized users stored in a memory of the fluid dispensing meter. In step 106, the processor determines if the user is authorized based on the comparison made in step 104. If the user-identification data does not match a user identity stored in the list of authorized users, then the answer is NO and the fluid dispensing meter will not allow the user to dispense fluid with fluid dispensing meter. If the user-identification data matches a user identity stored in the list of authorized users stored in the memory, then the answer is YES and method 100 proceeds to step 108.

In step 108, the processor of the fluid dispensing meter activates a trigger control mechanism, such as trigger control mechanism 24 (best seen in FIG. 1B). For example, the processor can provide power to a solenoid, such as solenoid 42 (best seen in FIG. 1B), to cause the solenoid to lock a trip rod in position within the fluid dispensing meter. With the trigger control mechanism activated, the trigger of the fluid dispensing meter is able to shift a valve within the fluid dispensing meter into an open position.

In step 110, the user dispenses the fluid with the fluid dispensing meter. In some examples, a preset fluid volume is associated with the user, such that the processor deactivates the trigger control mechanism based on the actual fluid volume dispensed reaching the preset fluid volume. Dispense information, such as the type of fluid dispensed, the identity of the user completing the dispense, the time of the dispense, the volume of fluid dispensed, and the location of the dispense are recorded. In one example, the dispense information is transmitted to a system controller, such as system controller 14 (FIGS. 1A, 2A, and 3), for fluid tracking and billing.

FIG. 5 is a flowchart illustrating method 200 of authorizing a fluid dispense. In step 202, a work order is generated for a discrete dispense event. The work order can include dispense information relevant to the dispense event, such as, among others, the type of fluid to be dispensed, the volume of fluid to be dispensed, the location of the dispense, and customer information. In step 204, dispense-authorization data, such as user-identification data and/or work order-identification data, is received by a fluid dispensing meter, such as fluid dispensing meter 12 (FIGS. 1A-3). The user-identification data can be passively provided to the fluid dispensing meter by an authentication device utilizing near field communications, such as authenticator 16 (FIGS. 1A and 3). For example, the user can wear a bracelet, watch, ring, belt, or other authentication device that is NFC enabled, and the user-identification data can be transmitted to a processor of the fluid dispensing meter by the authenticator. In another example, the dispense-authorization data is encoded in a visual identifier, such as visual pattern 64 (FIGS. 2A-2B and 3). The user can scan the visual identifier using an optical scanner, such as external optical scanner 66 (FIGS. 2A and 3) or integrated optical scanner 68 (FIGS. 2A-3).

In step 206, the dispense-authorization data provided to the fluid dispensing meter is step 204 is compared to authorized-dispense data stored in a memory of the fluid dispensing meter. In step 208, the processor determines if the user is authorized based on the comparison made in step 206. For example, the processor can compare the user-identification data to a list of authorized users stored in the memory. If the user-identification data does not match a user identity stored in the list of authorized users, then the answer is NO and the fluid dispensing meter will not allow the user to dispense fluid with fluid dispensing meter. If the user-identification data matches a user identity stored in the list of authorized users stored in the memory, then the answer is YES and method 200 proceeds to step 210.

In step 210, the current dispense event is associated with the work order. In some examples, each authorized user is authorized to complete fluid dispenses for multiple work orders. In one example, the current dispense event is associated with the work order by selecting the work order via a user interface of the fluid dispensing meter. The multiple work orders associated with the user can be displayed on a display screen, such as display screen 46 (best seen in FIG. 1C), of the fluid dispensing meter. The user can select the appropriate work order for the current dispense event by navigating the display screen with the input, such as user input 48 (best seen in FIG. 1C), and selecting the work order. In another example, the user work order data is encoded in a visual identifier, such as visual pattern 64, and the user scans the visual identifier into the fluid dispensing meter using an optical scanner, such as external optical scanner 66 or integrated optical scanner 68.

In step 212, the processor of the fluid dispensing meter activates a trigger control mechanism, such as trigger control mechanism 24 (best seen in FIG. 1B). For example, the processor can provide power to a solenoid, such as solenoid 42 (best seen in FIG. 1B), to cause the solenoid to lock a trip rod in position within the fluid dispensing meter. With the trigger control mechanism activated, the trigger of the fluid dispensing meter is able to shift a valve within the fluid dispensing meter into an open position.

In step 214, the user dispenses the fluid with the fluid dispensing meter. Where a preset fluid volume is associated with the work order and/or the user, the processor deactivates the trigger control mechanism based on the actual fluid volume dispensed reaching the preset fluid volume. Dispense information, such as the type of fluid dispensed, the identity of the user completing the dispense, the time of the dispense, the volume of fluid dispensed, and the location of the dispense are recorded. In one example, the dispense information is transmitted to a system controller, such as system controller 14 (FIGS. 1A, 2A, and 3), for fluid tracking and billing.

FIG. 6 is a flowchart illustrating method 300 of authorizing fluid dispenses. In step 302, a work order, and associated work order-identification data, is generated for a discrete dispense event. The work order-identification data can include dispense information relevant to the dispense event, such as, among others, the type of fluid to be dispensed, the volume of fluid to be dispensed, the location of the dispense, and customer information. In step 304, the work order is associated with specific authorized users, such that the fluid dispensing meter will activate only for the specific users associated with the work order. The work order-identification data and associated authorized users are transmitted to one or more fluid dispensing meters, such as fluid dispensing meter 12 (FIGS. 1A-3). In step 306, a dispense event is initiated by loading the work order to the fluid dispensing meter. For example, the work order number can be keyed into the fluid dispensing meter via a user interface of the fluid dispensing meter, or the work order number can be scanned into the fluid dispensing meter by an optical scanner, such as external optical scanner 66 (FIGS. 2A and 3) or integrated optical scanner 68 (FIGS. 2A-3).

In step 308, user-identification data is received by the fluid dispensing meter. The user-identification data can be passively provided to the fluid dispensing meter by an authentication device utilizing near field communications, such as authenticator 16 (FIGS. 1A and 3). For example, the user can wear a bracelet, watch, ring, belt, or other authentication device that is NFC enabled, and the user-identification data can be transmitted to a processor of the fluid dispensing meter by the authenticator. In another example, the user-identification data is encoded in a visual identifier, such as visual pattern 64 (FIGS. 2A-2B and 3). The user can scan the visual identifier using an optical scanner, such as external optical scanner 66 (FIGS. 2A and 3) or integrated optical scanner 68 (FIGS. 2A-3).

In step 310, the user-identification data provided to the fluid dispensing meter is step 308 is compared to a list of authorized users stored in a memory of the fluid dispensing meter. In step 312, the processor determines if the user is authorized based on the comparison made in step 310. If the user-identification data does not match a user identity stored in the list of authorized users, then the answer is NO and the fluid dispensing meter will not allow the user to dispense fluid with fluid dispensing meter. If the user-identification data matches a user identity stored in the list of authorized users stored in the memory, then the answer is YES and method proceed to step 314.

In step 314, the processor of the fluid dispensing meter activates a trigger control mechanism, such as trigger control mechanism 24 (best seen in FIG. 1B). For example, the processor can provide power to a solenoid, such as solenoid 42 (best seen in FIG. 1B), to cause the solenoid to lock a trip rod in position within the fluid dispensing meter. With the trigger control mechanism activated, the trigger of the fluid dispensing meter is able to shift a valve within the fluid dispensing meter into an open position.

In step 316, the user dispenses the fluid with the fluid dispensing meter. In examples where a preset fluid volume is associated with the work order and/or the user the processor deactivates the trigger control mechanism based on the actual fluid volume dispensed reaching the preset fluid volume. Dispense information, such as the type of fluid dispensed, the identity of the user completing the dispense, the time of the dispense, the volume of fluid dispensed, and the location of the dispense are recorded. In one example, the dispense information is transmitted to a system controller, such as system controller 14 (FIGS. 1A, 2A, and 3), for fluid tracking and billing.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid dispensing meter comprising:

a trigger control mechanism mounted in a body of the fluid dispensing meter, the trigger control mechanism controllable between an activated state, where the fluid dispensing meter can dispense fluid, and a deactivated state, where the fluid dispensing meter is prevented from dispensing fluid;

a data receiver mounted on the fluid dispensing meter, the data receiver configured to receive data from an external data source; and a control board disposed within the bezel housing, the control board comprising:

a processor; and a memory encoded with instructions that, when executed by the processor, cause the processor to:

recall approved user identities from the memory;

compare the approved user identities to user-identification data received from the external data source;

associate work order information with a user identified by the user-identification data; and control the trigger control mechanism between the activated state and the deactivated state based on the comparison of the user-identification data and the approved user identities.

2. The fluid dispensing meter of claim 1, wherein the data receiver comprises:

an antenna configured to receive the user-identification data from the external data source and provide the user-identification data to the processor.

3. The fluid dispensing meter of claim 2, wherein the antenna is configured to receive the user-identification data from an authenticator via near field communications.

4. The fluid dispensing meter of claim 1, wherein the data receiver comprises:

an integrated optical scanner mounted on the fluid dispensing meter; and wherein the external data source is a visual pattern, and the integrated optical scanner is configured to scan the visual pattern to receive the user-identification data.

5. The fluid dispensing meter of claim 4, wherein a bezel housing is mounted on the body of the fluid dispensing meter and the bezel housing includes a scanner opening extending through the bezel housing, and wherein the integrated optical scanner is configured to receive the user-identification data through the scanner opening.

6. The fluid dispensing meter of claim 1, wherein the trigger control mechanism comprises:

a solenoid mounted on the body; and a trip rod extending from the solenoid to a trigger of the fluid dispensing meter;

wherein the solenoid is configured to lock the trip rod in place within the meter body with the trigger control mechanism in the activated state, and the solenoid is configured to unlock the trip rod such that the trip rod is movable within the meter body with the trigger control mechanism in the deactivated state.

7. A fluid management system comprising:

an external data source configured to generate a user-identification signal including user-identification data;

a fluid dispensing meter comprising:

a trigger control mechanism mounted in a body of the fluid dispensing meter, the trigger control mechanism controllable between an activated state, where the fluid dispensing meter can dispense fluid, and a deactivated state, where the fluid dispensing meter is prevented from dispensing fluid;

a data receiver mounted on the fluid dispensing meter, the receiver configured to receive the user-identification data from the external data source;

a control board disposed on the fluid dispensing meter, the control board comprising:

a processor; and a memory encoded with instructions that, when executed by the processor, cause the processor to:

recall approved user identities from the memory;

compare the approved user identities to the user-identification data received from the authenticator;

associate work order information with a user identified by the user-identification data; and control the trigger control mechanism between the activated state and the deactivated state based on the comparison of the user-identification data and the approved user identities.

8. The fluid management system of claim 7, wherein the processor is configured to place the trigger control mechanism in the activated state based on the user-identification data matching at least one of the approved user identities.

9. The fluid management system of claim 7, wherein:

the external data source comprises an authenticator; and the data receiver comprises an antenna configured to receive the user-identification data from the authenticator and to provide the user-identification data to the control board.

10. The fluid management system of claim 9, wherein the authenticator comprises a near field communication (NFC) device.

11. The fluid management system of claim 10, wherein the authenticator is selected from a group consisting of an NFC access card, an NFC wristband, an NFC ring, and an NFC belt.

12. The fluid management system of claim 9, wherein the antenna is disposed within a bezel housing mounted on the body of the fluid dispensing meter.

13. The fluid management system of claim 7, and wherein:

the external data source comprises a visual pattern containing dispense-identification data;

the data receiver comprises an integrated optical scanner mounted on the handheld fluid meter, the integrated optical scanner configured to scan the visual pattern to receive the dispense-identification data and to transmit the dispense-identification data to the processor; and the memory is encoded with further instructions that, when executed by the processor, cause the processor to recall authorized-dispense data from the memory, to compare the authorized-dispense data to the dispense-identification data, and to control the trigger control mechanism between the activated state and the deactivated state based on the comparison of the authorized-dispense data and the dispense-identification data.

14. The fluid management system of claim 13, wherein the dispense-identification data is work order-identification data configured to identify a work order.

15. The fluid management system of claim 13, wherein the dispense-identification data is user-identification data configured to identify a user.

16. The fluid management system of claim 13, wherein the fluid dispensing meter further comprises:

a scanner opening extending through a bezel housing mounted on the body of the fluid dispensing meter, wherein the integrated optical scanner is configured to scan the visual pattern and receive the dispense-identification data through the scanner opening.

17. The fluid management system of claim 16, wherein the visual pattern is selected from the group consisting of a bar code and a QR code.

18. The fluid management system of claim 7, further comprising:

a peripheral device configured to receive work order-identification data and communicate the work order-identification data to the processor, wherein the processor is configured to recall authorized-dispense data from the memory, to compare the authorized-dispense data to the work order-identification data, and to control the trigger control mechanism between the activated state and the deactivated state based on the comparison of the work-order identification data and the authorized-dispense data.

19. The fluid management system of claim 18, wherein the peripheral device is an external optical scanner configured to receive the desired work order information from a visual identifier.

20. The fluid management system of claim 18, wherein the peripheral device is a system controller.

21. A method of authorizing a fluid dispense, the method comprising:

receiving user-identification data at a processor of a fluid dispensing meter, the user-identification data configured to identify a user;

recalling, from a memory of the fluid dispensing meter, a list of authorized users and comparing, with the processor, the user-identification data and the list of authorized users;

determining, with the processor, an authorization status of the user based on the comparison of the user-identification data and the list of authorized users;

generating work order information;

associating, with the processor, the work order information with the user based on the user-identification data; and controlling, with the processor, a trigger control mechanism of the fluid dispensing meter between an activated state and a deactivated state based on the authorization status of the user.

22. A method of authorizing a fluid dispense comprising:

generating work order information;

associating the work order information with a list of authorized users to generate a list of approved users;

transmitting the list of approved users to a fluid dispensing meter and storing the list of approved users in a memory of the fluid dispensing meter, wherein the list of approved users provides the list of authorized users;

receiving user-identification data at a processor of the fluid dispensing meter, the user-identification data configured to identify a user;

recalling, from the memory of the fluid dispensing meter, the list of authorized users and comparing, with the processor, the user-identification data and the list of authorized users;

determining, with the processor, an authorization status of the user based on the comparison of the user-identification data and the list of authorized users; and controlling, with the processor, a trigger control mechanism of the fluid dispensing meter between an activated state and a deactivated state based on the authorization status of the user.

* * * * *